United States Patent [19]

Wiholm et al.

[11] Patent Number: 4,863,332

[45] Date of Patent: Sep. 5, 1989

[54] METHOD AND APPARATUS FOR BINDING LOOSE SHEETS IN A FOLDER PROVIDED WITH BINDING AGENT

[75] Inventors: Sture H. Wiholm, Johanneshov; Jan Tholerus, Täby; Jan Leczinsky, Handen, all of Sweden

[73] Assignee: Bindomatic AB, Stockholm, Sweden

[21] Appl. No.: 160,577

[22] Filed: Feb. 26, 1988

[30] Foreign Application Priority Data

Mar. 2, 1987 [SE] Sweden ..... 8700867

[51] Int. Cl.[4] ..... B42C 9/00; B42C 3/00; B42C 5/00

[52] U.S. Cl. ..... 412/37; 412/8; 156/477.1

[58] Field of Search ..... 412/7, 37; 310/80, 83; 156/477.1, 499, 578, 351, 361, 366; 218/21 R

[56] References Cited

U.S. PATENT DOCUMENTS

| | | | |
|---|---|---|---|
| 3,902,646 | 8/1975 | Kuhns | 412/37 |
| 3,911,517 | 10/1975 | Davis | 412/37 |
| 3,928,118 | 12/1975 | Kuhns | 412/37 |
| 3,928,119 | 12/1975 | Sarring | 412/37 |
| 3,953,277 | 4/1976 | Kuhns | 412/37 |
| 3,954,548 | 5/1976 | Polit | 156/477.1 |
| 4,141,100 | 2/1979 | Domroe et al. | 412/37 |

*Primary Examiner*—Frank T. Yost
*Assistant Examiner*—Paul M. Heyrana, Sr.
*Attorney, Agent, or Firm*—Dressler, Goldsmith, Shore, Sutker & Milnamow, Ltd.

[57] ABSTRACT

In an apparatus for binding loose sheets in one or more folders there is utilized a regulating circuit means where an inserted folder (F) interrupts a light beam to a photodiode (16) which simultaneously starts a time counter (18) and closes the power supply (via 31) to the heating plate (2), wherewith the binding operation is carried out. The time interval of the timing counter is determined in response to the actual values of the width of the folders and the starting temperature of the heating plate. These values are obtained from a width detector (34, 7, 35) and a temperature detector (28), said values being fed into a microcomputer (19) controlling the timer. When the timer has counted down the time interval to zero, it interrupts the power supply to the heating plate (via 31).

17 Claims, 3 Drawing Sheets

Figure 1:
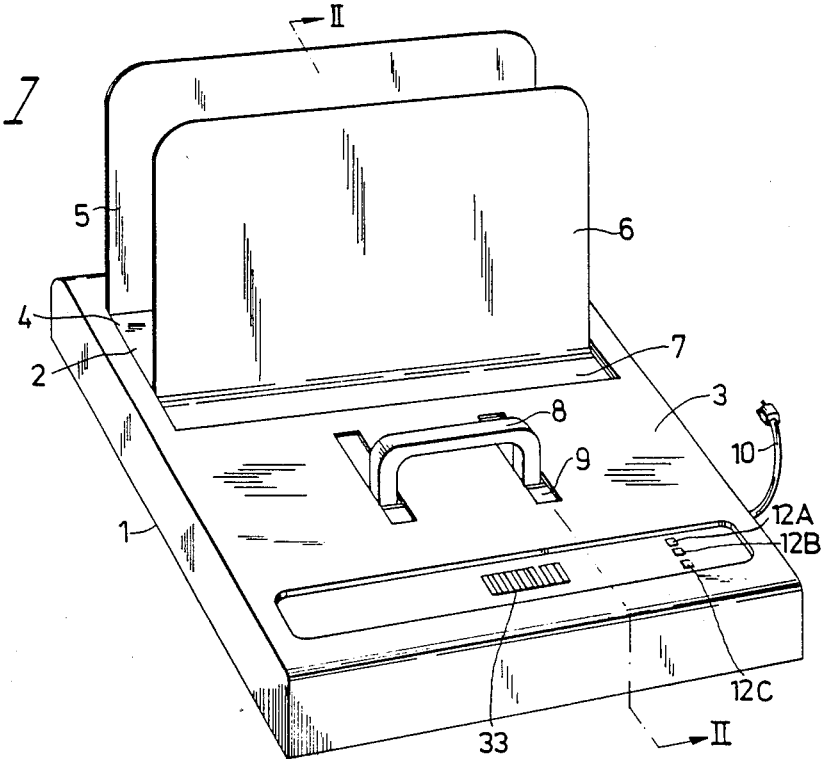

6
32
15
F
16
18
2
28
19
MP
31
to MP
11
12A
10

METHOD AND APPARATUS FOR BINDING LOOSE SHEETS IN A FOLDER PROVIDED WITH BINDING AGENT

TECHNICAL FIELD

The present invention relates to an improved method and improved apparatus for thermally binding sheets in a folder provided with binding agent, as is disclosed in the preamble to the following claims 1 and 4 respectively.

BACKGROUND ART

To avoid some drawbacks with older binder apparatus technique such as uncertainty in judging the length of time to be set for attaining a proper binding, a new technique was presented in the U.S. Pat. No. 4,367,116 "Binding Apparatus". By this technique the heating element was supplied continuously with power for maintaining a desired working temperature. Since the binding apparatus described in the patent was formed to cater for folders with a different number of pages by having an adjustable opening there was a demand for different operation times which were dependent on the actual folder thickness. This was solved by having a set of buttons for pre-setting the length of the operating time.

The known binding apparatus according to the mentioned U.S. patent is indeed simple to operate but relatively energy-demanding since it operates with a continuous power supply.

It has also been proposed to have intermittent power supply of the heating element in a binding apparatus, for example in the German patent 3 514 201. In this case a heat detector is arranged for sensing the temperature of the heating element, the power supply to which is interrupted after each binding operation. The heat detector output signal is used to control the start of the time switch so that the pre-set operating time is counted from and including the time when the heating element has reached its pre-determined working temperature, stated to be at least 90° C.

There has indeed been achieved that the power consumption is reduced to a certain extent, but the power consumption is still unnecessary, since it has been found during undertaken investigations that the binding operation can also utilize the time when the heating element has a lower temperature. Accordingly, the energy consumption could be brought to an absolute minimum if the time count on the time switch could be caused to take into account what starting temperature the heating element has when the folder is inserted in the opening of the binding apparatus. A basic condition is also to get the time count of the time switch to take into account the set width of the opening. This is achieved by the present invention.

DISCLOSURE OF INVENTION

According to one aspect of the present invention the improved binding apparatus includes a casing with a heating plate with an opening situated above the plate, the width of the opening being settably limited by a forward and a rear support means. The forward support means can also be movable for regulating the width of the opening with relation to the number and/or the thickness of the folders which are to be inserted into it. The outer surface of the heating plate is heated by a heating element when the folder (folders) engage against the outer surface for acting on the heat sensitive binding agent in each folder, wherewith the loose sheets inside the folder (folders) are bound. The electrical supply circuit feeding the heating element has a control means.

Characteristic for the method according to the invention is that the insertion of the folder (folders) energizes a starting circuit which actuates the timer from the insertion time, so that the heating element is kept supplied with power from the insertion time and during a pre-determined time interval, the length of which is dependent on the opening width and/or the starting temperature of the heating element.

By having the current control means depending on the number of inserted folders or on the total thickness of the folders there is obtained a definite power supply for the binding agent of the folders, independent of the number of pages which are included in the binding operation.

By having a temperature detector which continuously senses the temperature of the heating plate or heating element, it is possible to compensate for different starting temperatures of the heating plate. When the apparatus has been out of use for some time, and the heating plate is at room temperature the output signal of the detector can be used for setting the timer to a longer pre-determined time interval than when the apparatus is restarted after a short while, since the heating plate then has a temperature which is then closer to the normal working temperature.

An extremely well-adapted, optimum solution for reducing the energy consumption is to form the starting circuit with a computer circuit, preferably a microcomputer, the inputs of which are connected to (a) a light detector with a ray path extending over the opening above the heating plate and which is broken when the folder (folders) is inserted in the opening, (b) a width detector which senses the width of the opening and (c) a heat detector which senses the starting temperature of the heating plate. The computer circuit determines with the aid of fed-in detector signals the actual length of time that the timer shall hold the electrical power supply of the heating element connected from the time of the insertion of the folder (folders) until a satisfactory bond has been obtained.

In a preferred embodiment of the binding apparatus, there is a manually switchable time control circuit, which can similarly activate the computer circuit and has the function of extending the normally set time periods of the timer by a pre-determined value. Switching in the time control circuit is intended to be performed, e.g. when the material thickness of the folder or folders is greater than the thickness normally used, when a glue type other than the normal one is used, etc.

Another advantageous embodiment of the binding apparatus control circuit includes a time delay circuit, which is connected to the computer circuit for delaying interruption of the power supply to the heating element by a predetermined time after the folder or folders have been taken out from the opening or after the timer has reached its in-circuit time determined by the computer circuit.

PREFERRED EMBODIMENTS

Figure 3:
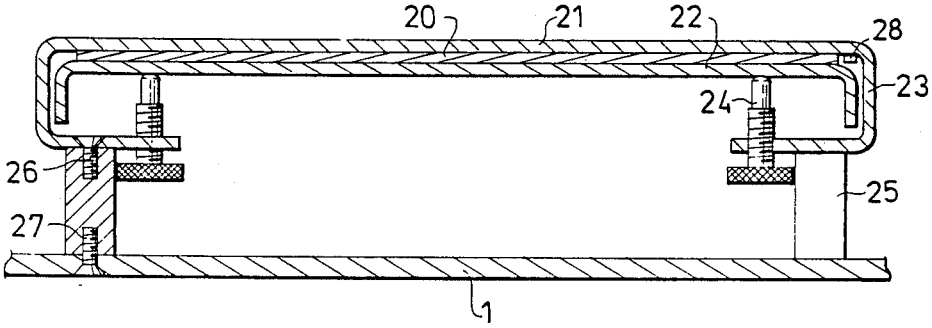
Figure 4:
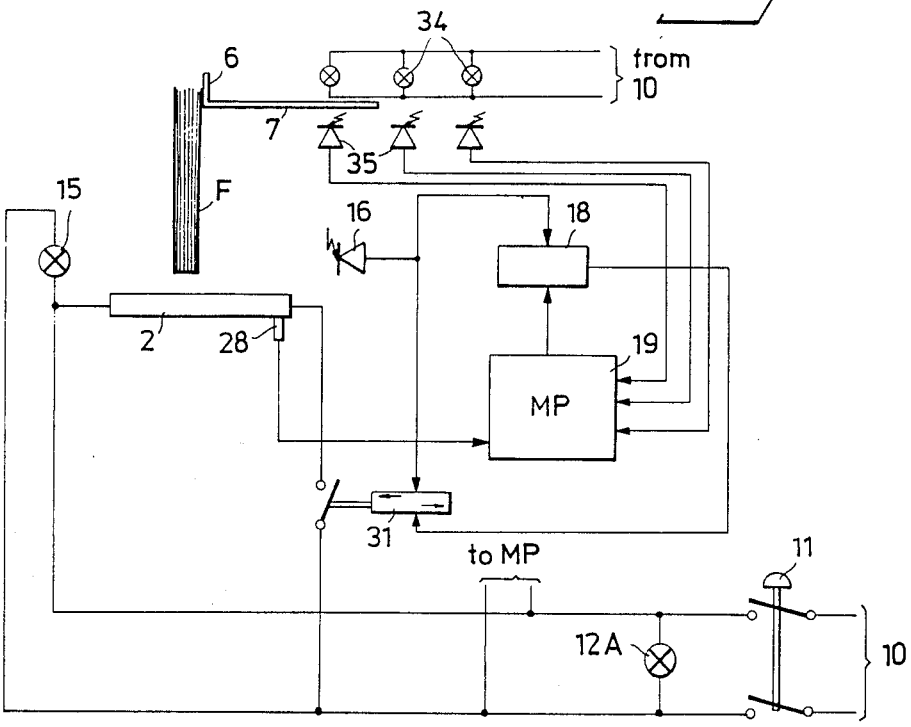
Figure 5:
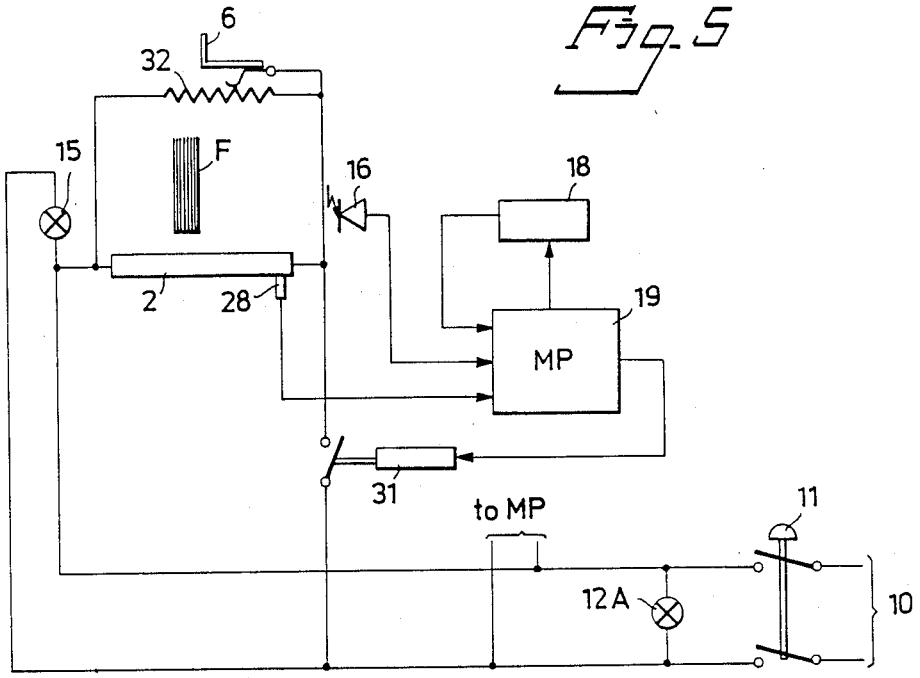

The above objects, properties and advantages of the present invention will be understood better from the preferred embodiments described below, which are not to be regarded as restricting for the invention but only as illustrating examples thereof. A description of the embodiments is given in conjunction with the accompanying drawings, where FIG. 1 is a perspective view of the binding apparatus in accordance with the invention, FIG. 2 is a section II—II according to FIG. 1, FIG. 3 is a cross-section of the heating plate included in the binding apparatus, FIG. 4 is a simplified circuit diagram depicting the basic principle for the binding apparatus in accordance with the invention, and FIG. 5 is a simplified circuit diagram agreeing with the one in FIG. 4, but with a modified functional principle for the binding apparatus in accordance with the invention.

The binding apparatus in accordance with the invention has, as will be seen from FIG. 1, a casing 1 surrounding a heating plate 2. The casing 1 has a table surface 3 at the rear end of which there is an opening 4 for enabling one or more folders to be inserted into contact with the heating plate 2. The opening 4 is restricted at its rear edge by a fixed rear support means 5 and at its forward opposing edge by a forward, displaceable support means 6. The displaceable means 6 is bent such as to have a part 7 situated in the immediate vicinity of the under side of the table surface 3. The part 7 of the support means 6 carries a handle 8 which projects up over the table surface 3 through slots 9 made in the table surface. There are also openings in the table surface for signal lamps 12A–C and 33. The signal lamp 12A is intended, when it illuminates, to indicate when the power supply is ON, which takes place with the aid of a main switch 11 on the rear side (FIG. 2) of the apparatus. The signal lamp 12B is intended, when it is illuminated, to indicate that the heating plate 2 is supplied with power, which takes place with the aid of a relay means 31 (FIGS. 4 and 5). The signal lamp 12C is intended, when it is illuminated, to indicate that the heating plate 2 operates at increased power, which can be switched on with the aid of a button (not shown) on one side of the main switch 11 on the rear side of the apparatus.

The signal lamp 33 comprises a series of LED's situated side by side, which symbolically denote the length of time which has been determined for an actual binding operation. The LED's 33 are extinguished one after the other as the binding operation proceeds, so that when the last LED 33 is extinguished the binding is ready, which can also be denoted by other signal means, e.g. by an audible signal. Of course, the LED's 33 can be replaced by other time indication means, e.g. a digital marker which counts down the time for the binding operation.

Figure 2:
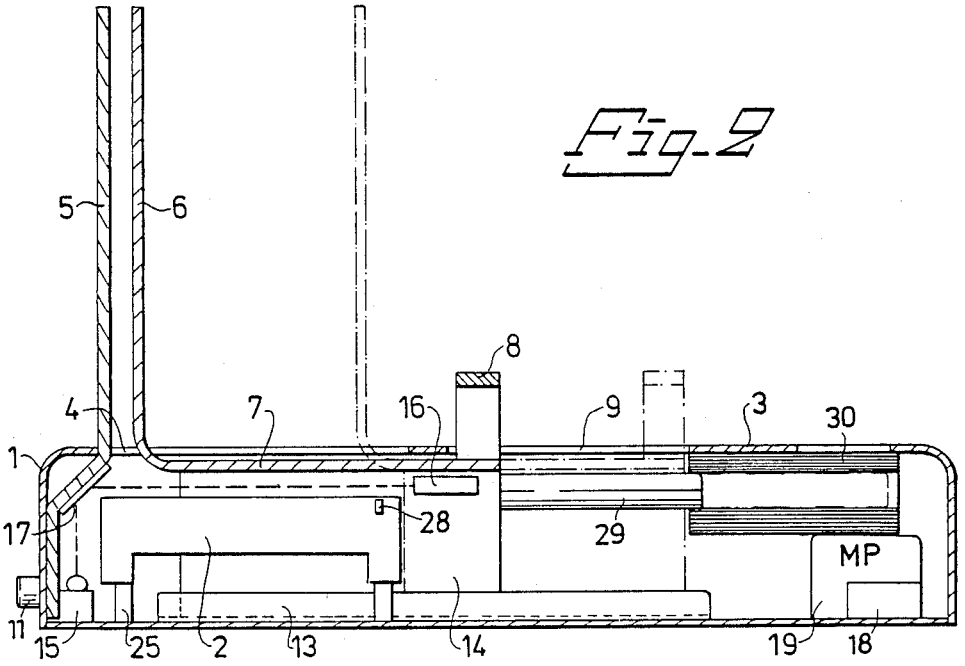

FIG. 2 is a section along the line II—II in FIG. 1, the forward, displaceable support means 6 being illustrated in two different positions where the chain dotted position is the one which gives the greatest opening 4 and thereby room for the thickest folder which can be bound or for the greatest number of thinner folders which can be bound at the same time. At the bottom of the casing 1 there are a pair of rails 13 attached for mounting the displaceable support means 6. The latter has on its bent-over portion 7 two parallel flanges 14 intended to run in the rails 13. The edges of the flanges 14 are coated with easily sliding material, e.g. in the form of TEFLON tape.

The bottom of the casing 1 also carries the heating plate 2, which will be described in more detail in conjunction with FIG. 3 below.

There is also a light source 15 arranged on the bottom of the casing 1 for illuminating a photocell 16 via a reflector 17. The reflector 17 can be formed as a bright surface on the fixed support means 5, which is bent to a suitable angle and attached to the rear end wall of the casing 1. The photocell 16 is suitably a phototransistor connected directly to or via a microcomputer (MP) 19 to a timer 18, the phototransistor being mounted at the end of the opening 4 situated on the opposite side of the fixed support means 5. A thermistor 28 is arranged in the immediate vicinity of the heating plate 2 and is similarly suitably connected to the microcomputer 19. The electrical circuit will be described in more detail in conjunction with FIGS. 4 and 5.

As will also be seen from FIG. 2, a detector for sensing the width of the opening 4 can be formed as a fixed coil 30 with a movable magnetic core 29. The core 29 is moved by the displaceable support means 6, on the flange 14 of which the core 29 is attached. The changed magnetic field which affects the detector coil 30 at different insertion lengths of the core 29 is utilized to generate an output signal indicating the actual width of the opening 4, i.e. the number of folders or the total thickness of the folder or folders which can be inserted in the opening 4.

The coil 30 and core 29 illustrated in FIG. 2 can also be connected to the supply circuit for the heating plate 2 analogous with what is shown in FIG. 5. Thus, there is obtained regulation of the power supply to the heating plate in relation to the number of inserted folders or the total thickness thereof.

The above-discussed width detector and/or effect regulating means 29, 30 can also be realized in other ways, e.g. with the aid of a transformer with a fixed primary winding and a movable secondary winding which is mechanically connected to the displaceable support means 6. Additional means for realizing this width detector are described in conjunction with FIGS. 4 and 5.

FIG. 3 illustrates in more detail the construction and mounting of the heating plate 2. Accordingly, the heating plate includes a heating foil 20 which is inserted between two surfaces 21, 22 of heat conductive material, e.g. aluminium. The upper surface 21 constitutes the support surface of the heating plate 2, against which the folder to be bound will rest. The lower surface 22 forms a holding plate intended to urge the heating foil 20 into intimate contact with the under side of the support surface 21. This is achieved by the support surface 21 being formed with flanges 23 in which threaded holes are made for screws 24. The ends of the screws 24 act on the holding plate 22, either directly on its under side or on flanges which are formed on the holding plate 22, in correspondence with the flanges 23 on the support surface. The thermistor 28 is shown arranged between both surfaces 21 and 22.

The heating plate 2 is mounted on the bottom of the casing 1 with the aid of bushes 25 which are fastened to the flanges 23 of the support surface 21 and to the bottom of the casing 1. This fastening is preferably carried out with screws 26, 27, which do not go straight through.

The function of the binding apparatus insures that it is always ready for a binding operation, i.e. at the start of the working day the apparatus is started by the main switch 11 being depressed. As will be seen from FIGS. 4 and 5, the signal lamp 12A is illuminated as well as the light source 15. The microcomputer 19 is also activated. The apparatus is thus prepared for its function when one or more folders F are to be bound. The folders may be of the kind described in conjunction with FIG. 4 in the U.S. Pat. No. 4 367 116.

When the operator desires to bind a folder, he only needs to put the folder F (or the folders if there are more than one) into the opening 4. No presetting of the binding time or temperature needs to be made.

The basic principle of the function of the binding apparatus is illustrated by the circuit diagram in FIG. 4. When the folder F or the folders are to be inserted into the opening 4 (FIGS. 1 and 2) the displaceable support means 6 is displaced so that an opening width is obtained suitable to the number of folders or the total folder thickness. The width detector then sends a signal corresponding to the position of the support means 6 to the microcomputer 19. In FIG. 4 the width detector is illustrated by three light sources 34 connected in parallel which are supplied with power from the power source 10, and a corresponding number of photodiodes 35. The light sources 34 and photodiodes 35 are situated on either side of the path of the bent over portion 7 on the displaceable support means 6. Accordingly, one or more of the photodiodes 35 will be screened from its associated light source 35 in response to the position of the support means 6, i.e. in response to the width of the opening 4.

The folder F or the folders are inserted in the opening 4 into engagement against the heating plate 2, the actual temperature of which is sensed by the heat detector 28, which preferably constitutes a thermistor and is connected to the microcomputer 19. On insertion of the folder/folders F the light beam from the light source 15 towards the photodiode 16 is interrupted, which causes a signal to be sent to the timer 18 and to the relay means 31, which closes the power supply circuit of the heating plate 2. The illustrated relay means 31 can also comprise transistor switching, a relay, or the like.

The timer 18 thus immediately starts counting a predetermined time interval when the folder or folders F are inserted in the opening 4. The starting value of the predetermined time interval is in response to the signals from the temperature and width detectors 28, 35, which are processed in the microcomputer 19, the latter in turn sending a signal to the timer 18.

The timer 18 is also connected to the LED's 33, all of which illuminate for maximum length of the pre-determined time interval, i.e. when the temperature of the heating plate 2 is equal to room temperature and the width of the opening 4 is at a maximum. For higher temperatures of the heating plate 2 and/or lesser opening widths a smaller number of LED's are illuminated. The number of illuminated LED's 33 decreases in time with the timer 18 counting down as described above in conjunction with FIG. 1.

When the timer 18 has counted down to zero, i.e. the binding is ready, the last LED 33 is extinguished, an optional audible signal is sent and the power supply to the heating plate 2 is broken off by the timer 18 sending a return signal to the relay means 31.

For certain purposes there may be a need of an increased temperature in the heating plate 2, or an extended time interval for binding. For example, the material in the folders which are to be bound may be thicker than normal and therefore require more energy for achieving a fully satisfactory binding. For this purpose, there is suitably arranged a time control circuit (not shown) which can be manually switched in, and which is connected to the timer 18 for extending the normal counting periods of the reckoner by a pre-determined value. Alternatively, the same increase in energy can be achieved by a temperature compensator which can be manually switched into the signal circuit of the temperature detector 28 for reducing the signal from the detector 28 by a pre-determined value. This energy-increasing compensation is controlled by a push button (not shown) as mentioned in conjunction with FIG. 2.

On certain occasions there may be a need of a delayed switching-off of the power supply to the heating plate 2, after the folder or the folders F have been taken from the opening 4 or after the timer 18 has reached its given ON time, i.e. it has reached the count value zero. This need can be satisfied by a delay circuit (not illustrated) which is suitably connectable to the microcomputer 19 or the relay means 31.

As mentioned above, the width detector illustrated in FIG. 4 in the form of the photodiodes 35 can instead comprise the coil 30 and core 29 or a transformer with a fixed primary winding and movable secondary winding. It is also conceivable to implement the width detector as a rheostat 32, the central terminal of which is connected to the displaceable support means 6.

A further modification of the basic idea of the present invention is illustrated in FIG. 5, namely that the width detector, here depicted as the above mentioned rheostat 32 is connected in parallel to the heating element 20 of the heating plate 2. In this case the output signal of the photodiode 16 is connected to the microcomputer 19 for controlling, together with the output signal from the temperature detector 18, the time interval of the timer 18.

Accordingly, the light beam from the light source 15 is interrupted when the folder F is inserted in the opening 4 (FIGS. 1 and 2), and the photodiode 16 generates a starting signal which is fed to the microcomputer 19. The starting signal activates the microcomputer 19 to simultaneously start the timer 18 and close the power supply to the heating plate 2 via the relay means 31. The power supply to the heating plate 2 is responsive to the number and/or total thickness of the inserted folders F. When the timer 18 has counted down to zero, it gives an output signal to the microcomputer 19, which, via the relay means 31 interrupts the power supply to the heating plate 2 and possibly activates other signal means in correspondence with what has been stated in conjunction with FIG. 4. The circuit depicted in FIG. 5 can also be built out with further functions of the kind disclosed in conjunction with FIG. 4.

As will be understood on studying the above mentioned, exemplifying embodiments of the binding apparatus in accordance with the invention, it can be realized in different ways within the scope of the invention. In the description and on the drawing certain components have been depicted as "mechanical", e.g. the relay means 31 and power regulating means/width detectors 29, 30 and 32, but these can very well be implemented using semiconductor techniques. The timer 18 which is depicted as a separate unit, can also be included in the microcomputer 19 as a part of the chip constituting the microcomputer. Other modifications of the binding apparatus are also conceivable, for which reason the description above and the exemplifications given on the drawings are not to be regarded as restricting the scope of the invention.

We claim:

1. A method of binding sheets in a folder provided with a binding agent with the aid of a thermal binding apparatus comprising the steps of:

(a) inserting one or more folders, each containing sheets which are to be bound through an opening (4) in the apparatus;

(b) bringing the folder into contact with a heating plate (2) having a heating element (20); and (c) activating the heating element;

(d) wherein the improvement comprises in the inserting step actuating a starting circuit (15,16) which activates a timer (18) at the insertion instant whereby said timer keeps the heating element supplied with power from the insertion instant and during a predetermined time dependent on the total thickness of the folder/folders and/or width of the opening and/or starting temperature of the heating element.

2. A method according to claim 1 wherein the width of the opening is set in response to the number of folders or to the thickness of the folder inserted by displacement of at least one of a pair of support means (5,6) restricting the opening.

3. A method according to claim 2 wherein the time interval for the transference of energy from the heating element to the folder or folders is increasable by a predetermined value by a manually switchable temperature compensator or time regulating circuit when folders with greater material thickness are inserted.

4. Apparatus for binding sheets in a folder (F) provided with binding agent comprising a casing (1) enclosing a heating plate (2), said casing having an opening (4) above the heating plate for insertion of one or more folders with sheets which are to be bound, rear support means (5) and forward support means (6) restricting said opening, the heating plate including an electrical heating element (20) connected to an electrical control circuit for the supply of power thereto, and a starting circuit (15,16) operationally connected to the heating element, said starting circuit being activated by the insertion of the folder or folders into the opening whereby the timer keeps the heating element supplied with power from the insertion instant and during a predetermined time interval which is responsive to the width of the opening and/or the starting temperature of the heating element.

5. Apparatus according to claim 4 wherein at least one of said support means is displaceable for setting the width of the opening to suit the number of folders and/or their thickness.

6. Apparatus according to claim 5 comprising a heat detector (28) operationally positioned for sensing the starting temperature of the heating element, width detector means (30,32,35) operationally positioned for sensing power supply relay means (31) in the electrical power supply of the heating element (20), the width of the opening, and a computer circuit (19) in the starting circuit, said computer circuit having inputs connected to said heat detector and to said width detector means and to said timer whereby the switching-in time of the timer is determined by the input signal from the heat and/or width detector means and which transfers an output signal to the power supply relay means.

7. Apparatus according to claim 6 wherein the width detector means comprises a plurality of photodiodes (35) and illuminating means (34) operationally associated therewith, said photodiodes being disposed along the displacing path of the displaceable support means such that in response to the assumed position of the support means one or more of the photodiodes sends a signal to the width detector input of the computer circuit.

8. Apparatus according to claim 7 wherein the illuminating means comprises a common illumination source (34) for all photodiodes (35).

9. Apparatus according to claim 6 wherein the width detector means comprises an electrical coil (30) and associated movable core (29), said core being mechanically connected to the movable support means.

10. Apparatus according to claim 6 wherein the width detector means comprises a rheostat mechanically connected to the movable support means.

11. Apparatus according to claim 6 wherein the rheostat is electrically connected in parallel with the heating element whereby the power supply to the heating element corresponds to the width of the opening.

12. Apparatus according to claim 6 wherein the width detector means comprises an electric transformer, the primary winding of the transformer being electrically connected to the power supply, and the secondary winding of the transformer being electrically connected to the heating element and mechanically connected to the movable support means for movement into and out of the primary winding.

13. Apparatus according to claim 6 wherein the heat detector means comprises a thermistor in mechanical contact with the heating plate or its heating element.

14. Apparatus according to claim 6 wherein the starting circuit comprises a light detector (16) whose ray path extends over the opening (4) whereby the ray path is interrupted by the insertion of a folder or folders in the opening.

15. Apparatus according to claim 6 comprising a mechanically switchable time control circuit connected to the timer for extending the normal timing periods of the timer by a predetermined value when folders having greater material thickness are inserted.

16. Apparatus according to claim 6 comprising a manually switchable temperature compensator connected to the signal circuit of the heat detector for reducing the signal value from the heat detector when folders of greater thickness are inserted.

17. Apparatus according to claim 6 comprising a delaying circuit connected to the computer circuit for delaying interruption of the power supply to the heating element by a predetermined time period after the folder or folders have been removed from the opening or the timer has reached its given switching-in time.

* * * * *